United States Patent [19]

Hoshi

[11] 4,002,152

[45] Jan. 11, 1977

[54] FUEL INJECTION CONTROL APPARATUS

[75] Inventor: Yoshikazu Hoshi, Ibaraki, Japan

[73] Assignee: Hitachi, Ltd., Japan

[22] Filed: July 14, 1975

[21] Appl. No.: 595,498

[30] Foreign Application Priority Data

July 19, 1974 Japan ..... 49-82188

[52] U.S. Cl. ..... 123/32 EA; 123/8.09

[51] Int. Cl.[2] ..... F02B 3/00

[58] Field of Search ..... 123/8.09, 32 G, 32 H, 123/32 EA, 32 AE, 101, 110, 112, 198 DB, 139 E, 140 ML

[56] References Cited

UNITED STATES PATENTS

| | | | |
|---|---|---|---|
| 3,196,846 | 7/1965 | Ohlendorf | 123/8.09 |
| 3,228,183 | 1/1966 | Feller | 123/8.09 |
| 3,614,945 | 10/1971 | Schlagmuller et al. | 123/32 EA |
| 3,673,989 | 7/1972 | Aono et al. | 123/32 EA |
| 3,699,932 | 10/1972 | Aono et al. | 123/32 EA |
| 3,898,936 | 8/1975 | Iwata et al. | 123/8.09 |
| 3,908,609 | 9/1975 | Iwata et al. | 123/32 EA |
| 3,916,865 | 11/1975 | Kiencke et al. | 123/32 EA |

*Primary Examiner*—Charles J. Myhre
*Assistant Examiner*—Paul Devinsky
*Attorney, Agent, or Firm*—Craig & Antonelli

[57] ABSTRACT

A fuel injection control apparatus has primary and secondary injection valves for effecting only the primary injection at low engine speeds while effecting both the primary and secondary injection at high speeds. Part of the switching operation between primary injection and combined primary and secondary injections is performed by the use of part of a fuel injection signal obtained from a memory.

4 Claims, 7 Drawing Figures

| BIT NO. 1 | 2 | 8 | INJECTION |
|---|---|---|---|
| 0 | 0 | 0 | ONLY PRIMARY |
| 0 | 0 | 1 | ONLY PRIMARY |
| 0 | 1 | 0 | ONLY PRIMARY |
| 0 | 1 | 1 | HOLD PREVIOUS STATE |
| 1 | 0 | 0 | HOLD PREVIOUS STATE |
| 1 | 0 | 1 | PRIMARY AND SECONDARY |
| 1 | 1 | 0 | PRIMARY AND SECONDARY |
| 1 | 1 | 1 | PRIMARY AND SECONDARY |

FUEL INJECTION CONTROL APPARATUS

BACKGROUND OF THE INVENTION

1. Field of the Invention

This invention relates to a fuel injection control apparatus for controlling fuel injection valves electronically and having a valve open time on which the amount of fuel injected depends, or more in particular to a fuel injection control apparatus for supplying fuel to a combustion chamber through two fuel injection valves depending on the rate at which the amount of fuel supplied to the combustion chamber is increased.

2. Description of the Prior Art

There is a conventional method for fuel control in which fuel is supplied by way of a couple of fuel injection valves or one of them provided for a combustion chamber in accordance with the engine operating conditions. The rotary engine is one of examples employing such a method.

In supplying fuel to a couple of combustion chambers each through a couple of fuel injection valves, it is necessary to produce independent valve opening signals to the respective injection valves. Also, the total amount of fuel supplied by way of these injection valves must coincide with a predetermined value. There is a need for overall control of the decision as to whether fuel injection should be effected through one or a couple of fuel injection valves and the valve open time of each injection valve on the basis of the decision.

SUMMARY OF THE INVENTION

Accordingly, it is an object of the present invention to provide a control apparatus capable of controlling a couple of injection valves with a simple circuit configuration in supplying fuel to a single combustion chamber by way of a couple of fuel injection valves.

Another object of the invention is to provide a fuel injection control apparatus in which the switching between fuel supply to the combustion chamber by way of a single fuel injection valve (which may herein-after be referred to as "single injection") and that by way of the two fuel injection valves (which may hereinafter be referred to as "dual injection") is accomplished smoothly.

Still another object of the invention is to provide a fuel injection control apparatus whereby fuel can be injected with high accuracy.

A further object of the invention is to provide a fuel injection control apparatus capable of controlling the switching between single and dual injection through a fuel injection valve(s) without increasing the capacity of a memory for recording data associated with the open time of the fuel injection valves.

A further object of the invention is to provide a fuel injection control apparatus whereby fuel can be injected properly in accordance with the variations in engine load.

According to one aspect of the invention, a signal representing the amount of fuel to be supplied to the engine in accordance with the operating conditions of the engine is produced from a memory. By the use of this signal, the control operation is effected for either single injection through one fuel injection valve or dual injection through a couple of fuel injection valves. In other words, in spite of the fact that a couple of injection valves are used for a single operation of combustion, only one memory is used for control according to the invention. In view of the fact that the memory and control circuits built around the memory pose the problem of an increased cost of the fuel injection control apparatus, the present invention has the advantages of both low cost and simple construction.

According to another aspect of the invention, the switching is effected between dual injection using two injection valves and single injection using a single injection valve in accordance with the engine load conditions. For this purpose, part of an output signal produced from the memory is used as a control signal, thus making it possible to reduce the memory capacity to a comparatively low level. According to the invention, it is possible to provide hysteresis characteristic in connection with the engine operating conditions at the boundary between the injection through a single fuel injection valve and that through two fuel injection valves. In the case where the engine continues to rotate at or in the vicinity of the switching boundary, the switching might be unstable between single and dual injection. This trouble is prevented by providing the hysteresis characteristic as mentioned above.

DETAILED DESCRIPTION OF THE PREFERRED EMBODIMENTS

Figure 1:
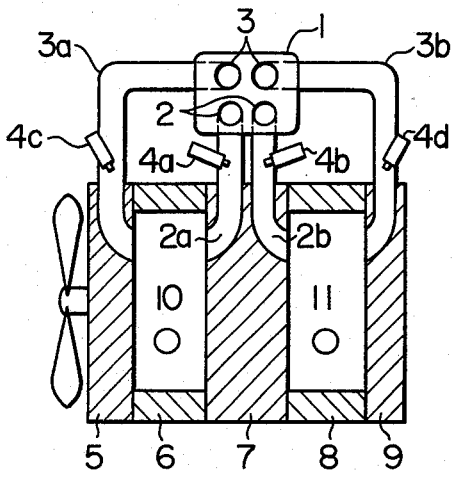
FIG. 1 is a schematic diagram showing a rotary engine to which the present invention is applied.

The embodiment described below comprises a rotary engine for which the apparatus according to the present invention is used. An intake system of the rotary engine is shown in FIG. 1.

A couple of rotary housings 6 and 8 interposed between an intermediate housing 7 and housings 5 and 9 on both sides respectively make up combustion chambers 10 and 11 of the rotary engine. The combustion chamber 10 will be hereinafter referred to as a front combustion chamber and the chamber 11 as a rear combustion chamber. A couple of intake paths 2*a*, 3*a*; and 2*b*, 3*b* are provided for the front and rear chambers respectively. The intake paths 2*a* and 3*a* are connected to the front combustion chamber 10 and the intake paths 2*b* and 3*b* to the rear combustion chamber 11. The other ends of all of the paths are concentrated at a throttle chamber 1.

In a comparatively low range of engine load, fuel is introduced into the front and rear combustion chambers through the primary intake paths 2*a* and 2*b*; whereas it is introduced into the respective combustion chambers by way of the secondary intake paths 3*a* and 3*b* when the engine load is increased. The intake paths are provided with fuel injection valves 4*a*, 4*b*, 4*c* and 4*d* respectively through which the amount of fuel, namely, the valve open time is controlled in accordance with the amount of intake in the respective intake paths.

Figure 2:
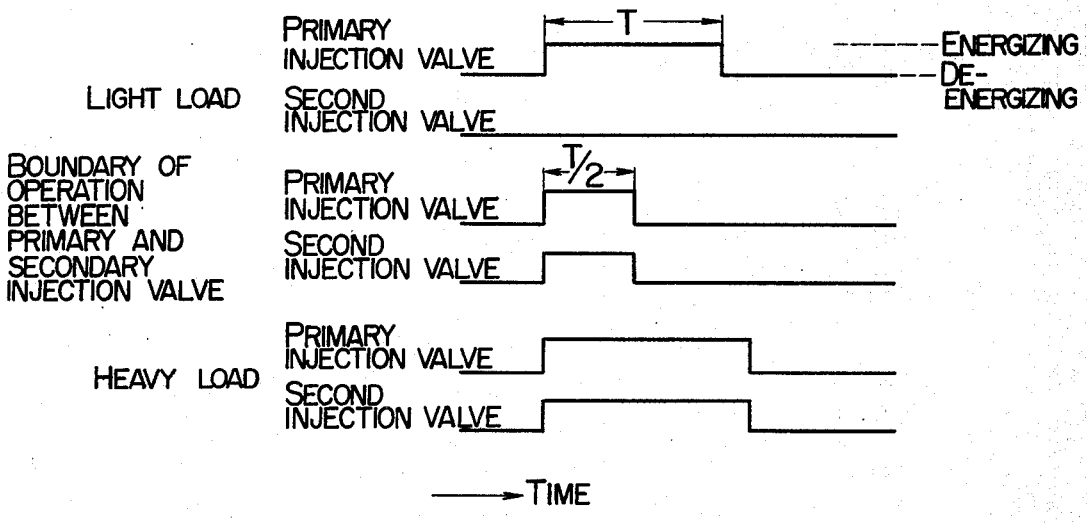
FIG. 2 is a chart showing the manner in which the two injection valves are controlled in association with a single combustion section according to an embodiment of the invention.

The fuel injecting operation of the respective injection valves will be explained with reference to FIG. 2. When the engine load is light, fuel is injected only through the primary injection valves 4*a* and 4*b*, so that with the increase in the engine load, the opening and the open time of the primary injection valves are increased. When the opening of the primary injection valves reaches a predetermined value, the secondary injection valves 4*c* and 4*d* open. Thus fuel is supplied through both the primary and secondary injection valves 4*a*, 4*b*, 4*c* and 4*d*. According as the engine load is increased, the amount of fuel injected by way of the primary and secondary fuel injection valves is increased.

In order to assure smooth switching from the actuation of merely the primary injection valves to that of both the primary and secondary injection valves, the embodiment under consideration employs an injection time about half that of the maximum fuel injection time of the primary and secondary injection valves at the time of switching to the dual injection of primary and secondary valves. The valve open time of the secondary injection valves, therefore, starts at a predetermined value. This contributes to an improved accuracy of the amount of fuel injected. Generally, the operation of the fuel injection valves causes an error of the fuel injection amount due to a delay of valve opening and closing. This error is greater, the shorter the valve open time. As mentioned above, the valve open time of the secondary injection valves starts not at zero but at a predetermined value according to the present invention, thus reducing the error of fuel injection amount which otherwise might be great due to the delay in the operation of the valves.

Figure 3:
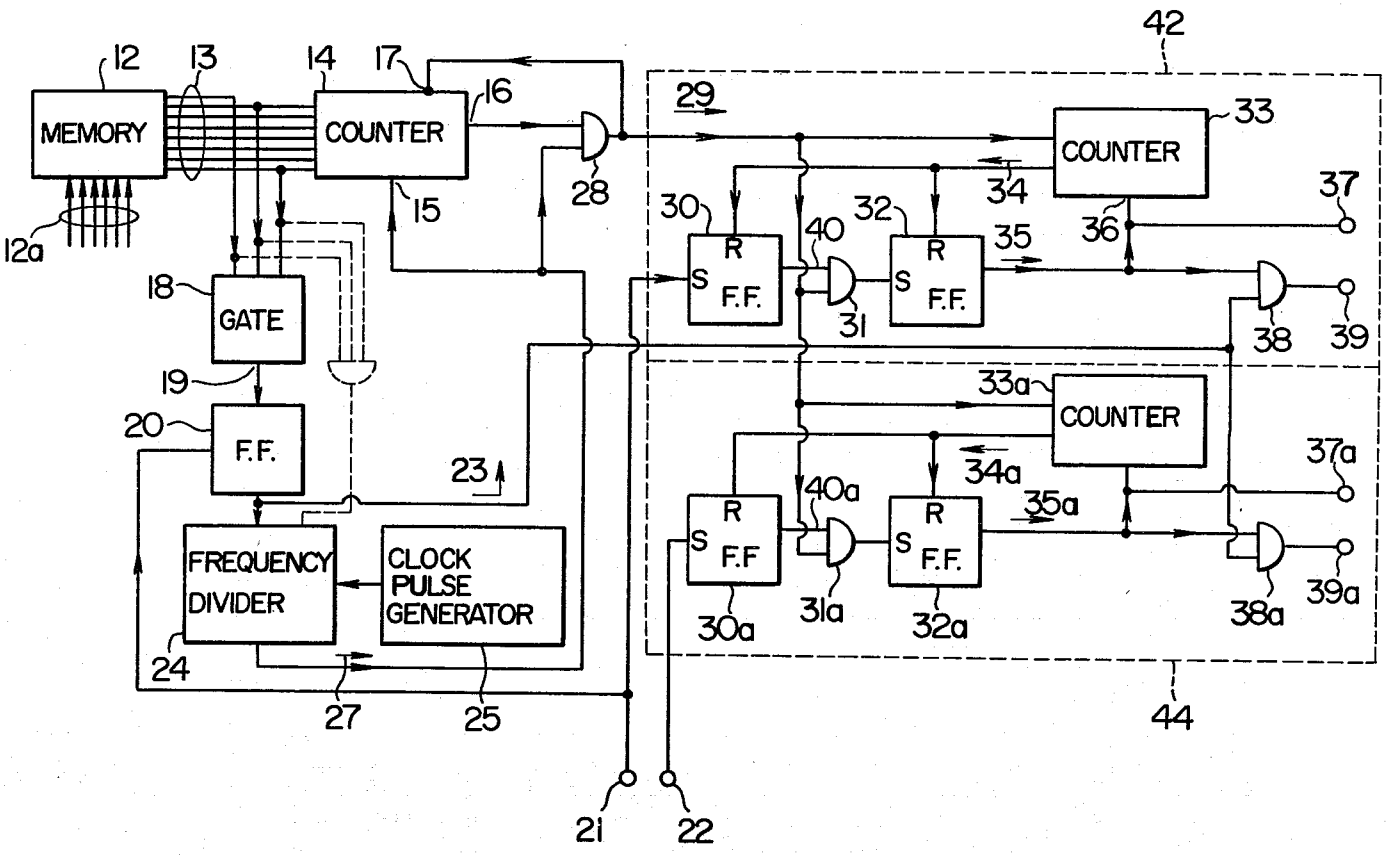
FIG. 3 shows a control apparatus according to an embodiment of the invention.

The control of the injection time of these fuel injection valves is effected by the control circuit shown in FIG. 3.

Reference numeral 12 shows a memory, which receives at input terminals 12*a* a digital signal of several bits associated with the engine operating conditions including the manifold pressure, throttle opening, amount of air absorbed and engine revolutions and produces binary data signal at the parallel output terminals 13. Numeral 14 shows a first counter preset in response to the data signal applied from the memory 12. The output signal from the memory 12 is introduced into and set in the counter 14 in the presence of a signal at the data input terminal 17. Each time a pulse signal is applied to the input terminal 15, the counter 14 counts up or down the numeric value registered therein, and produces a signal at the output terminal 16 when the difference between the preset value and the count value reaches zero or a predetermined value. Once the first counter 14 produces an output signal, the output from the AND gate 28 is applied back to the input terminal 17 of the counter 14. Also, when a pulse signal is applied to the input terminal 15 of the counter, it counts the signal again. As a result, output signals are produced periodically at the output terminal 16. Numeral 28 shows the first AND gate which produces an output signal in response to the output signal 16 from the first counter 14 and the pulse signal applied to the input terminal 15 of the first counter 14. Therefore, pulses having a period corresponding to the output signal of the memory 12 are produced from the AND gate 28.

In this way, the data stored in the memory 14 is read and a corresponding output 29 produced in accordance with the engine operating conditions. This signal is used as an electrical input signal for controlling the energization time of electromagnetic coils making up the injection valves, and represents, in the embodiment under consideration, a valve equal to one integral-th of a required valve open time. By multiplying this signal by an integral number, the injection valves are so controlled as to be kept open during time period when the electromagnetic valves an kept energized by the electrical signal.

On the other hand, numeral 18 shows a gate circuit to which binary signals of several repetition frequencies among those signals produced from the output terminals of the memory 12 are applied. In response to a predetermined combination of such binary signals, the gate circuit 18 produces an output signal at its gate output terminal 19.

Numeral 20 shows a flip-flop controlled by the output of the gate 18 and a front injection signal applied thereto from the input terminal 21. The output of the controlled flip-flop 20 undergoes a change depending on the ouptut produced at the gate output terminal 19 at the instant of rise of the front injection signal 21 (which may alternatively be the rear injection signal). This variation of output is caused only at the rise point of the front injection signal. Even when the gate output signal of the gate 18 changes at other than the rise point, the output of the flip-flop 23 undergoes no change at all.

Numeral 24 shows a frequency-divider circuit for reducing to half the period of the output pulses of the clock pulse generator 25 the oscillation frequency of which is controlled by a signal (not shown in the drawing) which is a digitized result of such compensating factors and conditions as the atmospheric temperature, atmospheric pressure, engine temperature and like.

This frequency-divider circuit 24 is deenergized in the absence of an output signal from the controlled flip-flop 20. In such a case, the clock pulse 26 itself is produced as a control clock pulse 27.

Numeral 30 shows a flip-flop for determining the period of the operation of the front-side control circuit and is energized and produces a high-level output in response to a front injection signal applied to the terminal 21.

Numeral 31 shows a front synchronizing AND gate for synchronizing the operation of the control circuit with the control output signal of the gate 28 and produces an output signal in response to the control signal 29 in the presence of an output from the flip-flop 30.

Numeral 32 is a flip-flop energized by the output of the AND gate 31. The electromagnetic coils of the injection valves are energized as long as the flip-flop 32 produces an output of a high level.

A second counter 33 starts to be energized at the rise point of the output of the flip-flop 32, and produces a counting-over signal 34 after a predetermined number has been counted, thereby reversing the state of the flip-flops 30 and 32.

As a result, the high-level output 35 of the flip-flop 32 is applied to the front-side primary injection valve output terminal 37 during the period from the starting to the ending of the counting of the control signal 29 from the AND gate 28 by the counter 33.

In the embodiment under consideration, the data in the memory represents one integral-th of the actual injection valve open time and therefore the counter 33 is used to multiply it by the integral number to obtain the actual valve open time. In the event that the output of the memory 12 represents an actual valve open time, by contrast, the counter 33 is not needed and the output from the AND gate 31 represents an injection time signal for the electromagnetic valve.

Numeral 38 shows and AND gate for controlling the secondary injection valve control signal on the front side and is energized in response to the output signal 35 from the flip-flop 32 and the output signal 23 from the flip-flop 20. When the output signal 29 from the AND gate 28 is applied to the AND gate 38 while the output signal 23 is applied thereto, the same output signal is produced at the terminal 39 as at the primary side terminal.

The signal from the output terminal 37 is used to control the fuel injection valve 4*a*. Further, the output signal from the terminal 39 controls the fuel injection valve 4*c*.

Numeral 42 shows a circuit block surrounded by a dashed line for controlling the two injection valves 4*a* and 4*c* on the front side, while the lower block 44 shows a control circuit for controlling the two injection valves 4*b* and 4*d* on the rear side. The construction on the rear side is quite the same as that on the front side, and will not be described in detail here as the numerals 30*a* to 40*a* in the drawing denote like component circuit elements and signals as numerals 30 to 40 on the front side.

Incidentally, the rear side control circuit 44 is energized when the rear injection control signal is applied to the terminal 22.

Generally, there is a phase difference between the combustion steps in the front combustion chamber and the rear combustion chamber of the engine, and therefore they are supplied with fuel at different time points. Even though the front side control block 42 operates the same way as the rear side control block 44, there is a phase difference between the operation time points thereof.

Figures 4, 5:
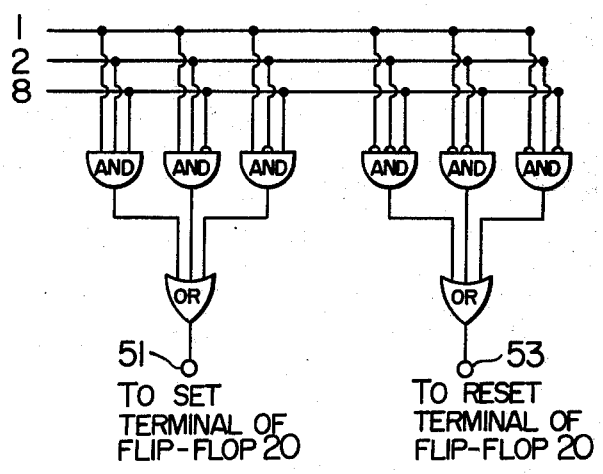
FIG. 4 is a table showing parts of circuit signals for explaining the method of control according to the invention.
FIG. 5 is a diagram specifically showing the circuit arrangement of part of the circuit used in the invention.

FIG. 4 is a table for comparing the input states with the output states of the gate circuit 18. Since the gate circuit 18 is impressed with binary signals of first, second and eighth bits (the rate of change of a binary signal being maximum at the terminal of the first bit and minimum at the terminal of the eighth bit), the output of the gate circuit 18 may be controlled by the use of a combination of the three types of binary signals.

A specific circuit for producing such a gate signal as signal 19 may be obtained by the combination of NOR gates as shown in FIG. 5.

The control circuit as constructed above operates as described below with reference to the output signal charts for each section shown in FIGS. 6 and 7. When the digital signal 12*a* showing an engine operating condition is applied to the memory 12, a corresponding data signal is produced from the memory. This signal is counted by the counter 14 while at the same time part of the data signal is applied to the gate circuit 18. In this way, it is decided whether only the primary side should be subjected to injection, or fuel be injected by way of both the primary and secondary sides, or the preceding condition be maintained. Depending on the result of this decision, the pulse frequency from the clock pulse generator 25 is determined.

Suppose both the primary and secondary injection signals are produced in the state of "1" output from the gate circuit 18. The flip-flop 20 is energized and the output signal 23 is produced, so the the frequency-divider 24 is de-energized while at the same time the output signal 23 is applied to one of the input terminals of the AND gates 38 and 38*a* for controlling the front and rear secondary injection valves.

Figure 6:
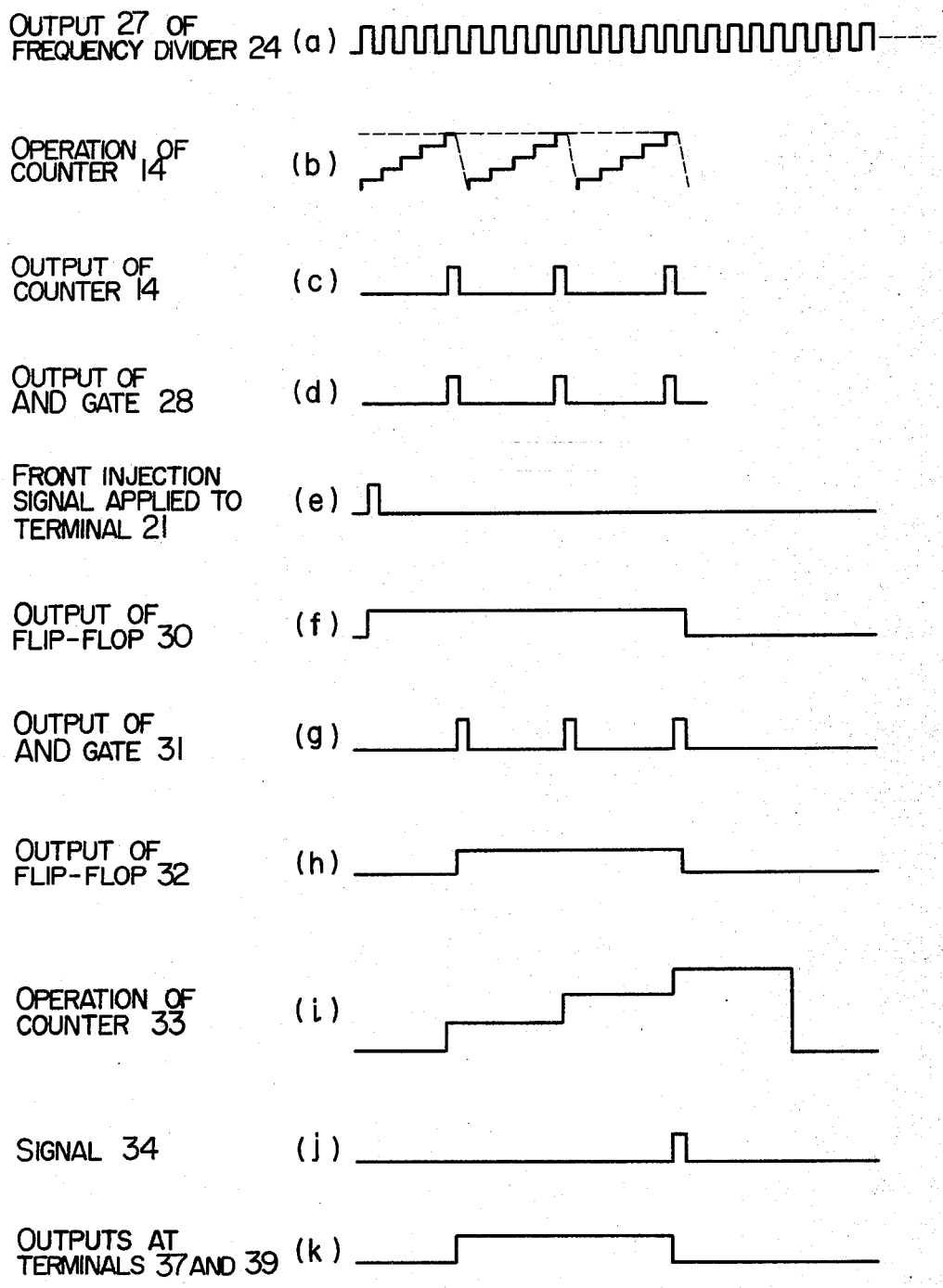
FIGS. 6 and 7 are charts showing signals produced from various parts of an embodiment of the invention in operation.

As a result, the clock pulses 27 are produced in the frequency not divided as shown in (6) of FIG. 6. The clock pulses 27 are applied to the pulse input terminal 15 of the counter 14, which in turn counts them in the manner shown in (*b*) of FIG. 7. When the counts coincide with the output data of the memory 12, the counter 14 produces a latch signal 16 shown in (*c*) of FIG. 7 which is applied to the AND gate 28.

Figure 7:
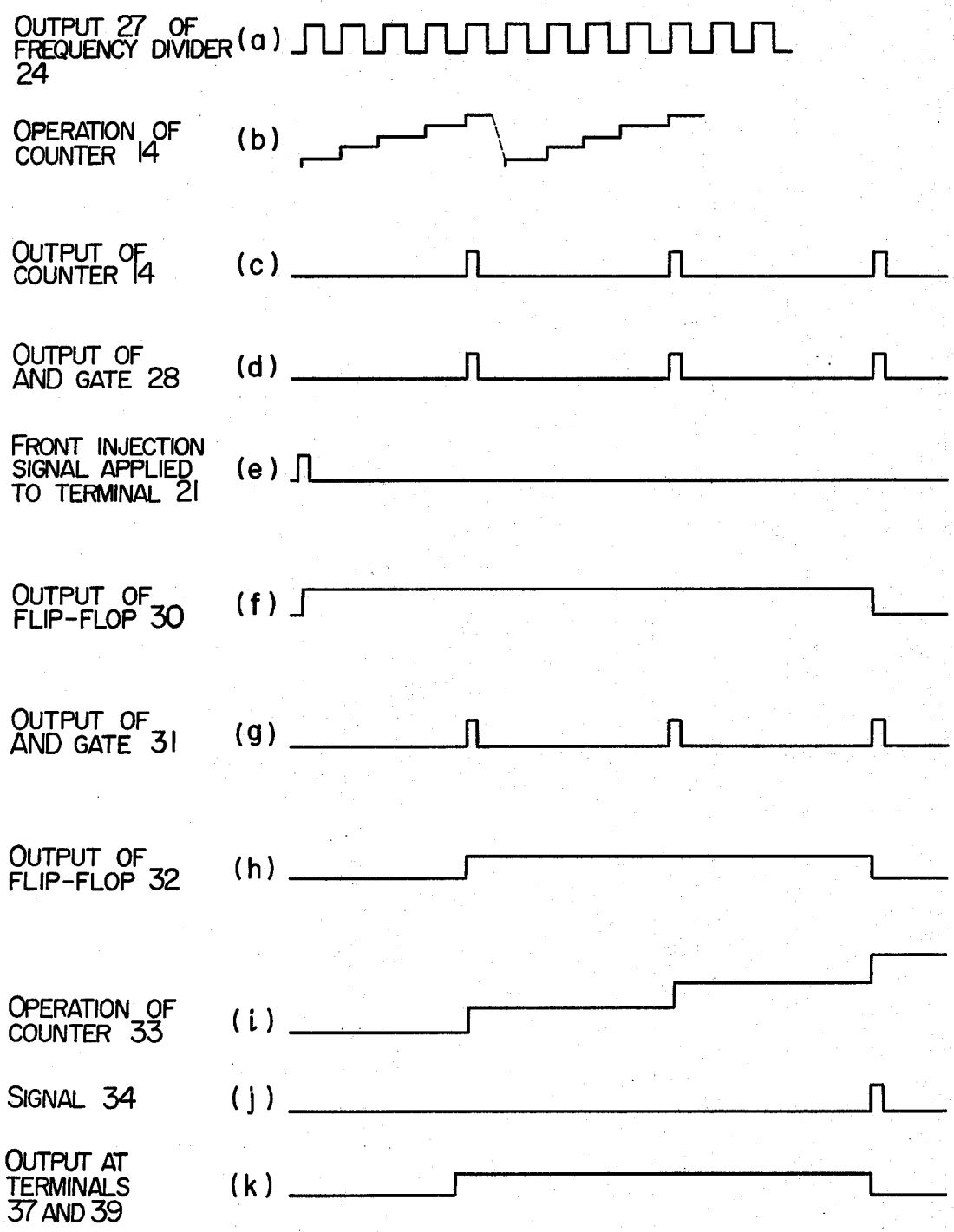

When the clock pulse 27 is applied to the other terminal of the AND gate 28, the pulse signal 29 as shown in (*d*) of FIG. 7 is produced from the AND gate 28, with the result that the counter 14 is restored to its original state for restarting the counting operation.

In this way, the counter 14 produces pulses 29 at intervals corresponding to the input data through the AND gate 28.

Naturally, a change in the input data causes a change in the intervals at which the latch signals are produced, thus changing the time intervals of the pulse signals 29.

These pulse signals are applied to the counters 33 and 33*a* and the synchronizing AND gates 31 and 31*a* of the front and rear control circuits.

Under this condition, the application of the front injection signal to the terminal 21 as shown in (*e*) of FIG. 7 causes the flip-flop 30 to be energized, thus producing an output signal as shown in (*f*) of FIG. 7. This signal is applied to the AND gate 31, so that when the pulse signal 29 is applied to the other terminal of AND gate 31, the signal as shown in (*g*) of FIG. 7 is produced from the AND gate 31.

This last-mentioned signal energizes the flip-flop 32, thereby producing the control signal 35 shown in (*h*) of FIG. 7. The control signal 35 is applied to both the control terminal 37 of the primary injection valve and the control input terminal 36 of the counter 33 at the same time, whereupon the counter 33 begins to count the control signal 29 shown in (*i*) in FIG. 7. After completing the counting of a predetermined number of the control signal, the counter 33 produces a latch signal 34 as shown in (*j*) of FIG. 7, so that the flip-flops 30 and 32 are reversed, thereby erasing the outputs 40 and 35 respectively. At the same time, the control signal which otherwise might be supplied to the injection valve control terminal 37 is also erased, and therefore the power to the electromagnetic valve or injection valve is also cut off.

On the other hand, the primary side injection control AND gate continues to be impressed with the output signal 23 from the flip-flop 20. Therefore, when the control signal 35 is produced from the flip-flop 32, the control signal is also applied to the secondary side injection valve control terminal 39. Further, with the reversing of the flip-flop 32, the control signal is also erased and controlled in the same manner as at the primary side.

At this time, the control signal shown in (*k*) of FIG. 7 is being produced at the injection valve control terminals 37 and 39.

In short, the counter 33 begins its counting operation at the control pulse signal 29 first arriving after the application thereto of the front injection signal, and both the primary and secondary injection valves continue to be operated to supply fuel until a predetermined number of control pulses 29 have been counted.

Assume, on the other hand, that the signal 19 from the gate circuit 18 is "0" and the injection signal for only the primary side is produced. The frequency divider 24 is energized and the clock pulses from the clock pulse generator 25 are reduced to ½ in frequency in the embodiment under consideration. The intervals of the output signal 16 from the counter 14 become twice as long. (Actually, not exactly twice but the output signal 16 is delayed by the time corresponding to the increase in the value of the data 13. Therefore, the intervals of the signal 16 are slightly longer than twice as referred to above.) The intervals of the control pulse signals 29 are enlarged and the time required before completion of the counting of the predetermined value by the counter 33 changes. The injection valve control signal 35 changes, thus controlling the injection valves in accordance with the engine operation conditions.

Even though the present enbodiment involves the case in which in effecting injection only at the primary side, a control signal is obtained which has an interval about twice as long as when both the primary and secondary injections are involved, the rate of frequency division of the clock pulse may be determined at a desired value.

Also, the amount of injection may be changed in any desired way by appropriately changing the rate of frequency division in accordance with the operating conditions. In other words, by appropriately selecting the compensating factors or conditions for changing the rate of frequency division of clock pulses, the control of the amount of injection may be changed in as many steps as desired, thus making possible the shifting of injection amount very smoothly.

Suppose, for example, that three inputs to the gate circuit 18 are applied to a logic circuit as shown by a dashed line in FIG. 3 to obtain a logic product thereof so that the rate of frequency division is made ½ irrespective of the output of the flip-flop 20. Then the same length of control time for the injection valves is obtained when both the primary and secondary injections are involved as when only the primary injection is effected, thus permitting fuel supply approximately twice greater than in the ordinary case.

Referring to FIG. 4, when signals of bits 1, 2 and 8 applied to the gate 18 are in the states of (0, 1, 1) or (1, 0, 0), an output is produced at none of the gate output terminals 51 and 53 in FIG. 5. Thus the flip-flop 20 is maintained as it is. In other words, a hysteresis characteristic is obtained for the reason as described below.

While the engine load is changing from a low level to a high level, injection is effected only through the primary injection valves **4*a* and 4*b* if the bit outputs 1, 2 and 8 from the memory 12 are in the state of (0, 0, 0), (0, 0, 1) or (0, 1, 0). Even when the signal (0, 1, 1) or (1, 0, 0) is applied from the memory 12, the flip-flop 20 holds its present state. As a result, fuel is injected only through the injection valves 4*a* and 4*b*.**

When the engine load is decreasing from a large to small value, by contrast, the flip-flop 20 is set. In the "1" state of the output of the flip-flop 20, a signal is produced through the AND gates 38 and **38*a*, so that the injection valves 4c and 4d in addition to the valves 4*a* and 4*b*** are actuated for injection.

When the engine load is further decreased, the signal applied from the memory 12 to the gate 18 changes to the state of (0, 1, 1) or (1, 0, 0). In this case, differing from the above-mentioned case, the flip-flop 20 holds its set state. Under this condition, therefore, the two types of injection valves **4*a*; 4*b* and 4*c*; 4*d*** are both actuated.

Even when the engine operation is maintained in the boundary between single combustion and dual combustion, the fuel injection operation is free from instability.

It will be noted from the foregoing description that according to the present invention a signal for selecting the primary or secondary injection is formed by a signal obtained from partial change in the output of the memory 12. In this way, the output of the injection control time operational circuit can be delivered either only to the primary side or to both the primary and secondary sides at the same time as desired. It is thus possible to obtain a control apparatus suitable for fuel control of an engine having a couple of mixed-gas intake paths for each combustion section, each path having a fuel injection valve associated therewith.

Further, the control apparatus according to the present invention is very simple in construction and large in allowance of control accuracy, thus leading to a great advantage.

In other words, the objects of the invention can be achieved merely by providing the gate circuit 18 having a simple combination of elements, the control flip-flop 20 and the AND gates 38 and **38*a*.** The functions of the present invention are such that not only the primary or secondary injection valve operation is selected but the rate of frequency division of the clock pulses applied to the operational circuit for processing the injection control output can be changed. As a result, it is no longer necessary to make the injection amounts per unit time of the primary and secondary injection valves the same.

When the amount of the injection fuel supply to the engine is small, it is desirable to make the fuel injection amount per unit time small for the purpose of enhancing the fuel injection accuracy. Therefore, by decreasing the fuel injection amount per unit time of the primary injection valve and by increasing the fuel injection amount per unit time of the secondary injection valve, a better fuel injection apparatus is obtained.

By the way, the input to the gate circuit 18 in the embodiment under consideration, namely, the binary-coded signal 13 applied to the gate circuit 18 from the parallel output terminals of the memory 12 may be comprised of two types; one out of the signals representing the input data to the counter 14 and the other a signal for the sole purpose of gate circuit 18. If the change in the signal at the output terminal for the sole purpose of the gate circuit 18 is made dull, and the change in other two are twice and four times as sharp as the first-mentioned signal respectively, then there are a greater number of combinations available, thus offering a wider range of freedom of selection.

It has already been described above that the present invention employs a control circuit having a memory, as an example of the control circuit for controlling the two types of fuel injection amount, and a control signal for energizing or de-energizing one of the injection valves in accordance with the engine operating conditions is obtained from part of the output signals of the memory. However, this method for obtaining the control signal for energizing or de-energizing either injection valve according to the operating conditions may be replaced by many other methods in embodying the invention.

In other words, the control signal under consideration, which is a signal obtained by discriminating at least the two ranges of load conditions during the operation of the engine, may alternatively be obtained from the input signal to the memory or directly on the basis of the revolutions, throttle opening, engine temperatures, manifold pressure, air intake and the like.

Furthermore, the spirit of the present invention is not limited to the apparatus controlling the injection valves by a control circuit having a memory as in the above-described embodiments but the invention may of course be applied with equal effect to the commonly-used mechanical, electrical or electronic fuel injection control apparatus used as a multistage fuel injection control apparatus of the type described above.

In such cases, the load conditions of the engine during its operation may be mechanically, electrically or electronically identified, as mentioned above, on the basis of such factors related to the load condition as the engine revolutions, throttle opening, engine temperatures, manifold pressure, air intake and the like. By so doing, the signal obtained may be used to control the switching between energization and de-energization of either injection valve in accordance with the engine operating conditions.

I claim:

1. In a fuel injection control apparatus comprising a memory for producing an output representing a required amount of fuel injection in accordance with the engine operating conditions, a first injection valve for supplying fuel to said engine, a second injection valve for supplying fuel to said engine when the load on said engine is great, and means for introducing fuel injected through said first and second fuel injection valves to a combustion chamber, said apparatus producing pulses having time intervals corresponding to the data produced from said memory, said first and second fuel injection valves being driven for fuel injection in response to said pulses; the improvement further comprising detector means for detecting an injection control signal produced together with said data produced in accordance with the engine operating conditions, and first gate means for controlling said second injection valve, said first gate means being energized in response to said injection control signal, said second injection valve being driven by said pulses having the time intervals corresponding to the output data from said memory.

2. A fuel injection control apparatus according to claim 1, in which said detector means for detecting said injection control signal comprises second gate means, first transmitter means for connecting the output terminal of said memory and the input terminal of said second gate means, and means for holding the output of said gate means, said memory producing an output applied through said first transmitter means to the input terminal of said second gate means, said second gate means producing an output applied to said holding means, said holding means producing an output applied to said first gate means.

3. A fuel injection control apparatus comprising a memory for producing data representing a required amount of fuel injection in accordance with the engine operating conditions, counter means for producing time pulses representing the data from said memory in response to pulses in the number associated with the value of said data produced from said memory, first injection means for supplying fuel to said engine in response to a pulse signal produced from said counter means, second injection means for supplying fuel to said engine, first gate means for transmitting the output pulse signal for said counter means to said second fuel injection means, second gate means for detecting the requirement for energization of said first gate means, means for transmitting the output of said memory to said second gate means as a control signal for said second injection means, means for holding the output of said second gate means which is generated in response to the signal transmitted from said memory to said second gate means by said transmitter means, and second transmitter means for applying the output of said holding means to said first gate means in such a manner as to energize said second fuel injection means.

4. A fuel injection control apparatus according to claim 3, further comprising means for producing pulses to be applied to said counter means, and means for changing the frequency of said pulses in accordance with the output of said holding means, said pulse-frequency changing means increasing the frequency of pulse input to said counter means when said second fuel injection means is actuated.

* * * * *